US008025615B1

(12) United States Patent
Sargent

(10) Patent No.: US 8,025,615 B1
(45) Date of Patent: Sep. 27, 2011

(54) EXERCISE ROLL BAR DEVICE

(76) Inventor: Jim Wallace Sargent, Florence, AL (US)

( * ) Notice: Subject to any disclaimer, the term of this patent is extended or adjusted under 35 U.S.C. 154(b) by 773 days.

(21) Appl. No.: 10/845,903

(22) Filed: May 15, 2004

(51) Int. Cl.
*A63B 71/00* (2006.01)

(52) U.S. Cl. ..... 482/139; 482/49; 482/50

(58) Field of Classification Search ..... 482/95, 482/106, 122, 125, 132, 91, 908, 108, 121, 482/124, 126, 131, 49, 50, 92, 105, 133–139
See application file for complete search history.

(56) References Cited

U.S. PATENT DOCUMENTS 4,900,017 A * 2/1990 Bold, Jr. ..... 482/132
5,498,223 A * 3/1996 Iams et al. ..... 482/129
6,017,293 A * 1/2000 Pfefferle ..... 482/40
6,203,476 B1 * 3/2001 Wang et al. ..... 482/121
6,629,913 B2 * 10/2003 Chen ..... 482/129
6,761,672 B1 * 7/2004 Williams ..... 482/132
6,837,837 B2 * 1/2005 Nethery ..... 482/132
7,011,610 B2 * 3/2006 Wawrzyniak ..... 482/106
7,087,004 B1 * 8/2006 Berke ..... 482/136

* cited by examiner

*Primary Examiner* — Glenn Richman
(74) *Attorney, Agent, or Firm* — Ariel S. Bentolila; Bay Area IP Group, LLC

(57) ABSTRACT

An exercise device and method that is suitable to provide lateral stabilization of the exerciser performing a squatting exercise is provided. The device includes an exercise bar, and wheels that are located, in some implementation, at least the width of a doorframe. Some embodiments of the exercise bar further include a means to adjust its length and to cause vertical resistance. The lateral stabilization method includes the steps of aligning the wheels of the wheeled exercise bar to properly engage the vertical guiding surface; and engaging the vertical guiding surface with the wheels of the wheeled exercise bar such that the wheels roll with sufficient frictional or normal force thereon to provide lateral stabilization to the user.

8 Claims, 5 Drawing Sheets

EXERCISE ROLL BAR DEVICE

FIELD OF THE INVENTION

The present invention relates generally to exercise equipment. More particularly, the invention relates to portable exercise equipment assisting in load balancing.

BACKGROUND OF THE INVENTION

Numerous stationary exercise devices are known in the art, including free weights, pulley, and resistance based devices to name a few. Some are designed to workout certain groups of muscles by constraining the motion of the user such that common exercise techniques, like squats and leg presses, may be performed in a controlled, safe manner. These stationary devices are often large, bulky gym equipment systems, which for the squat exercise, for example, typically have a bar that travels along two parallel tracks to assist the user to balance while performing the squat exercise. However, stationary exercise devices are not always available or convenient for an individual to use outside of a gym, and are relatively expensive to own or gain access to. Portable exercise devices are often preferable for individuals seeking relatively inexpensive exercise equipment to use privately or in remote locations. Unfortunately, conventional portable exercise devices lack the safety and controlled workout benefits provided by stationary exercise devices, especially for exercises such as squats.

It is well known that individual tend to have trouble balancing themselves while performing the squat exercise. A version of the squat exercise is done by placing a weight-bearing exercise bar on the shoulders or chest (front squat), where while in a standing position, the body is lowered by bending the knees until the thighs are roughly parallel to the floor. The squat exercise is completed by returning up to the starting position. This exercise is usually repeated many times to increase metabolism and help strengthen the thighs, buttocks, calf, back, hamstrings and other various muscle groups. The problem with performing squats is in keeping your balance while moving your body in the up and down motion while supporting a weight-bearing exercise bar. In the context of a regular, stationary gym environment, an individual seeking to keep their balance, and safely perform the squat exercise, often requires either what is known as a "spotter" or specialized stationary gym equipment.

In view of the foregoing, there is a need for portable exercise equipment, which enables users to safely perform load-balancing exercises, such as squats. It would also be desirable if such a portable solution were lightweight, inexpensive, and did not require the assistance of others to use.

BRIEF DESCRIPTION OF THE DRAWINGS

The present invention is illustrated by way of example, and not by way of limitation, in the figures of the accompanying drawings and in which like reference numerals refer to similar elements and in which.

Figure 1A:
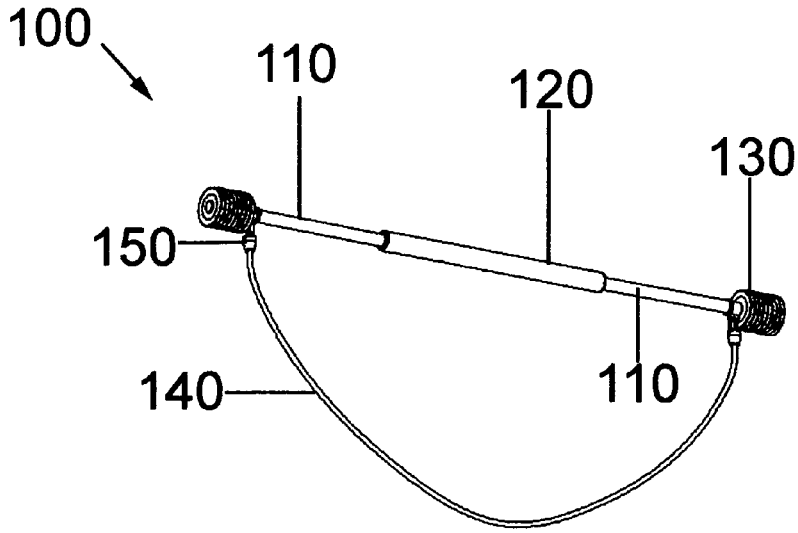
FIG. 1*a* illustrates a front perspective view of a first embodiment of an adjustable exercise bar.

Unless otherwise indicated illustrations in the figures are not necessarily drawn to scale.

SUMMARY OF THE INVENTION

To achieve the forgoing and other objects and in accordance with the purpose of the invention, a lateral stabilization, exercise device and method is provided.

In one embodiment, an exercise device is provided that includes an exercise bar suitable for gripping with both hands by a user, and wheels that are located at least the width of a doorframe. Some embodiments of the exercise bar further include a means to adjust its length. In certain application, the predetermined range is the range of widths of common doorframes, which in some implementations may be limited to at least the width of a common doorframe.

The wheels of some embodiments of the present invention are configured to properly engage a surface of the doorframe or a wall surface just beyond the doorframe such that the wheels can sufficiently roll on either surface and provide adequate lateral stabilization of the human performing a squatting exercise inside the doorframe area when gripping the exercise bar.

To provide more exercise to the user, yet other embodiments of the present invention further include a means attached to the exercise bar to resist motion induced by the user. Suitable resistance means includes, but is not limited to, elastic bands, tension tubes, springs, or a hydraulic mechanisms. Depending on the application, the resistance means may be removably or permanently attached to the exercise bar.

A method is also provided that laterally stabilizes a user performing a squatting exercise in between vertical guiding surfaces, such as the vertical sides of a doorframe, while gripping with both hands the wheeled exercise bar. The lateral stabilization method includes the steps of aligning the wheels of the wheeled exercise bar to properly engage the vertical guiding surface; and engaging the vertical guiding surface with the wheels of the wheeled exercise bar such that the wheels roll with sufficient frictional or normal force thereon to provide lateral stabilization to the user.

To achieve lateral stabilization, the user of the wheeled exercise bar according to an embodiment of the present invention may use as the vertical guiding surface a doorframe or a wall surface just beyond the doorframe. In some applications, the step of adjusting the length of the wheeled exercise bar such that the wheels substantially align with the vertical guiding surface may be required.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments.

The present invention is directed to a multipurpose exercise device that enables a user to exercise various muscle groups through at least one mode of operation including a configuration preferable to safely performing an exercise commonly referred to as the 'squat.' A first embodiment of the present invention is configured as an adjustable exercise bar with wheels rotatably attached on each end. The structural configuration of the first embodiment is designed to assist the user in balancing him or herself while performing the squat exercise by using a commonly available doorframe, or similar structure, as a wheel guide that keeps the exercise bar substantially constrained to vertical-only motion, thereby assisting in load balancing by limiting the side-to-side, front-to-back motion during the squat exercise.

FIG. 1*a* illustrates a front perspective view of the first embodiment in completed form as an adjustable exercise bar 100, which includes a gripping section 110 joined on the inside to a bar adjustment section 120, and on the outside to a wheel section 130. Gripping section 110 and bar adjustment section 120 may be made of any suitable material including, but not limited to, metals, plastics, and wood. The present embodiment is further provided with an elastic resistance band 140 that is removably, but fixedly connected to gripping section 110 at a band connection point 150, which may be implemented as rigid loops. The overall length of adjustable exercise bar 100 may be adjusted by bar adjustment section 120 to a desired length that permits wheel section 130 to properly engage a vertical motion guide, such as a doorframe, as will be described in some detail below in connection with FIG. 2. By way of example, and not limitation, for a doorframe application, bar adjustment section 120 may be configured to cause wheel sections 130 to be located wide enough so that the user can symmetrically engage a doorframe such that adjustable exercise bar 100 is relatively easily vertically rolled up and down the inside door frame molding, door frame facing or wall area just outside of door frame facing when, thereby assisting the user to balance against the doorframe while performing the squat exercise within the doorframe area.

Figure 1B:
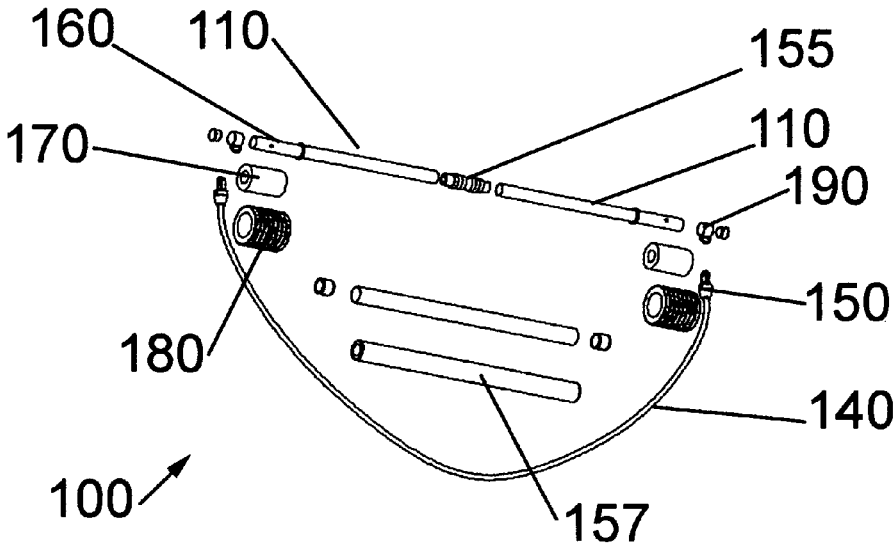
FIG. 1*b* illustrates a front exploded view of the first embodiment of an adjustable exercise bar.

Each section of the first embodiment may be itself embodied in a multiplicity of suitable implementations known to those in the art. One of many possible approaches is shown in FIG. 1*b* where gripping section 110 is implemented as a load supporting tube, and bar adjustment section 120 is implemented as a adjustment member 155, which, in the present embodiment, is screwed into the inner end of gripping sections 110 until the desired overall length is achieved. Depending on the application, adjustment member 155 may be optionally covered by an adjustment member cover 157, which provides safety and or esthetic benefits to the user. In the embodiment shown, the outer end of gripping sections 110 are properly grooved with axle sections 160 that receive a rotatable axle sleeve 170, which sleeve has an outer wheel material 180 fixedly mounted thereon, thereby forming wheel section 130. The wheel sections 130 are held in lateral place by end caps 190, which caps are suitably configured according to known techniques to allow the wheels to freely roll, but not slide off gripping sections 110. Those in the art will readily recognize a multiplicity of alternative construction techniques in accordance with the teachings of the present invention. For example, and not by way of limitation, adjustment member 155 may be implemented in any number of alternative ways (not shown) to safely enable length adjustment, such as, telescoping, canonically extending tubes, or sliding tubes that are removably fixed in place with spring loaded pins, just to name a few. Similarly, wheel sections 130 may be readily implemented according to a multiplicity of known techniques that optimally suit the requirements of the particular application. Hence, adjustable exercise bar 100 may be readily configured to fit most standard walk-through door frames, whereby wheel section 130 is designed to roll on door frame facing or wall area outside of door frame facing.

The particular application will dictate variations to the first embodiment that those skilled in the art will readily appreciate and implement. For example, in a second embodiment (not shown), only the adjustable exercise bar from the first embodiment is provided, whereby elastic resistance band 140 and associated components are not included. By way of further example, a third embodiment (not shown), the adjustable exercise bar from the second embodiment is configured to, instead, be non-adjustable, by way of example, and not limitation, adjustment member 155 might be disabled or removed and gripping sections 110 could be one continuous member having the desired length (e.g., cut to the width of a standard door frame). The third embodiment may include, of course, elastic resistance band 140 and associated components as were provided in the first embodiment.

Figure 2A:
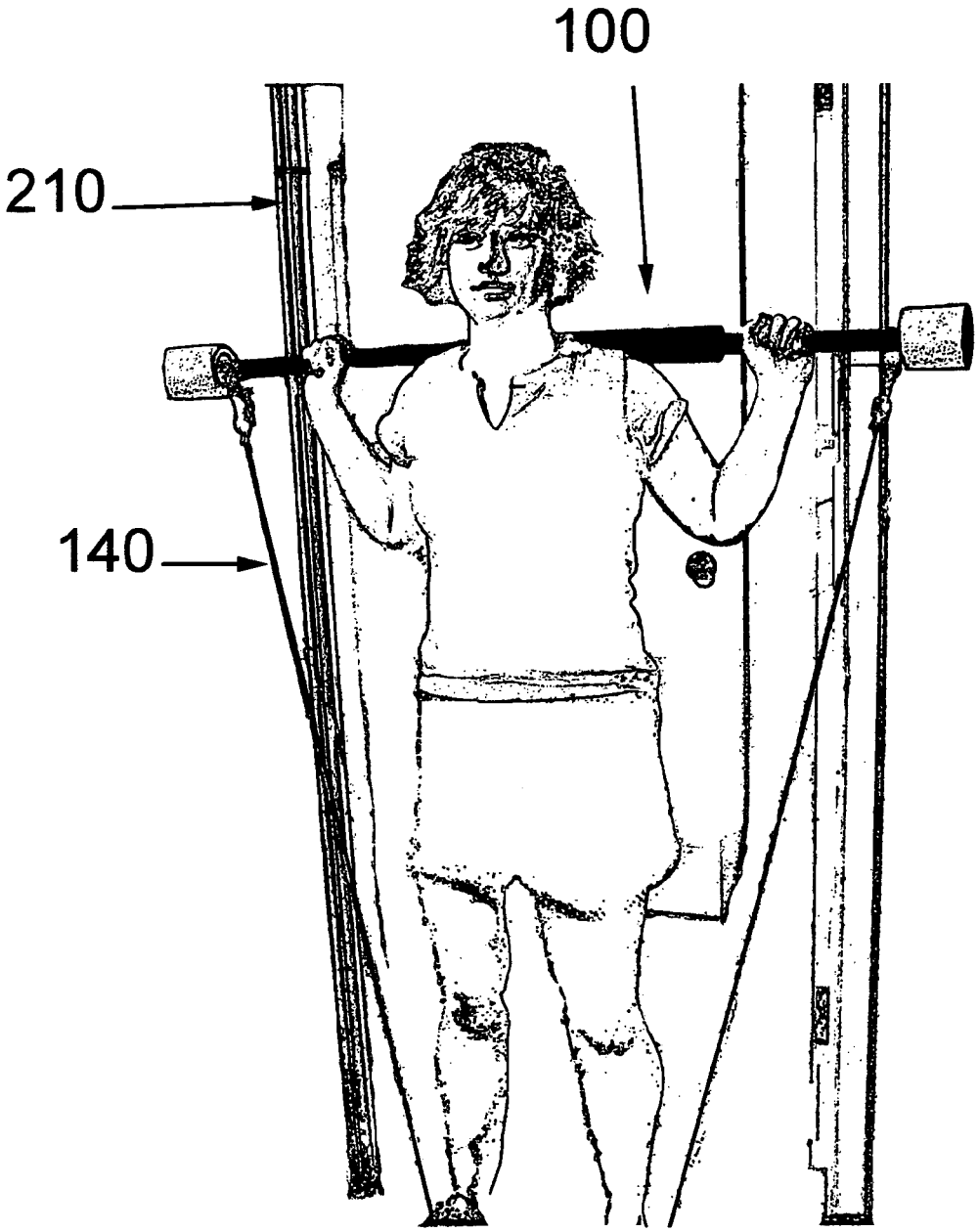
FIG. 2*a* illustrates an example of the first embodiment used in a doorframe example of the "Squat" exercise at an initial position.

FIG. 2*a* illustrates an example of the first embodiment used in a doorframe example of the "Squat" exercise at an initial position. In the example shown, the user determines the optimal length of adjustable exercise bar based on their usage experience. The length of adjustable exercise bar 100 is set by properly adjusting bar adjustment section (not shown) to result in a width substantially equal to the guiding part of a doorframe 210 to be used. By way of reference, and not limitation, standard doorframe typically range from 32" to 42" in width. Hence, in the present example, the length of adjustable exercise bar 100 would be adjusted such that wheel section 130 will properly roll on the door frame facing, inside door molding, wall area located outside of door-frame facing, or any surface that serves as a vertical guide to assist the user in balancing during the squat exercise. Once the desired length is determined, the user would proceed with locking the adjustment member in place so that it does not slip out of the desired position while performing the squat exercise. Next the user places adjustable exercise bar 100 on their shoulders, behind the neck and optionally stands on the bottom of elastic resistance band 140 to provide added load if desired. While standing within the door framed area, the user will align wheel sections 130.*on* each end of adjustable exercise bar 100 with the vertical guiding surface such that the wheels are resting up against the vertical guiding surface.

Figure 2B:
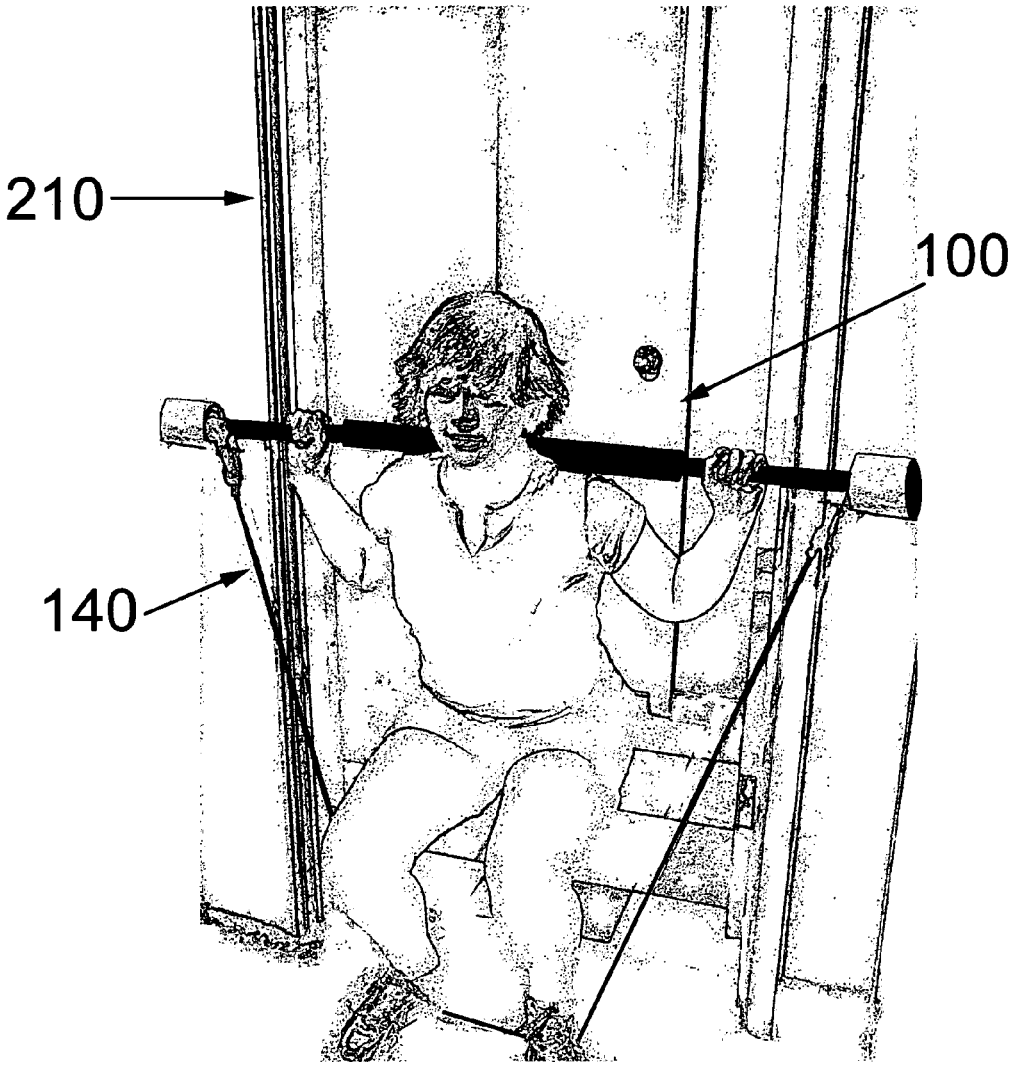
FIG. 2*b* illustrates an example of the first embodiment used in a doorframe example of the "Squat" exercise at an engaged position.

FIG. 2*b* illustrates an example of the first embodiment used in a doorframe example of the "Squat" exercise at an engaged position, whereby the user uses his or her own body weight for resistance and proceeds with the squat exercise by bending their knees and moving their body in an up and down motion, while wheel sections 130 roll on the vertical guiding surface to assist in maintaining a substantially vertical up and down motion. It should be appreciated that horizontal stability is substantially improved at least by the horizontal constraining tendency of the normal and frictional forces generated as wheel sections 130 engage the vertical guiding surface. In an aspect of the present embodiment, the user will have a natural tendency to lean backwards towards the load bearing side of their body, e.g., leaning backwards, thereby reinforcing the engagement of wheel sections 130 onto the vertical guiding surface. Hence, when adjustable exercise bar 100 is used as described, the user will more easily balance him or herself, and substantially avoid swaying or wobbling, while performing the squat exercise at least because the vertical guiding surface, e.g., the doorframe, acts very similar to the rigid track used in conventional stationary squatting exercise devices. To adjust the amount of a additional load beyond the user's own body weight, the length of elastic resistance band 140 is selected such that a desired maximum load is achieved at the initial position shown in FIG. 1. The factors of properly selecting the properties of elastic resistance band 140 is well known to those skilled in the art. Of course, the foregoing description applies to second, third, and fourth embodiments of the present invention with appropriate modifications; e.g., no adjustment of the bar length or no elastic resistance band placement step.

Figure 3:
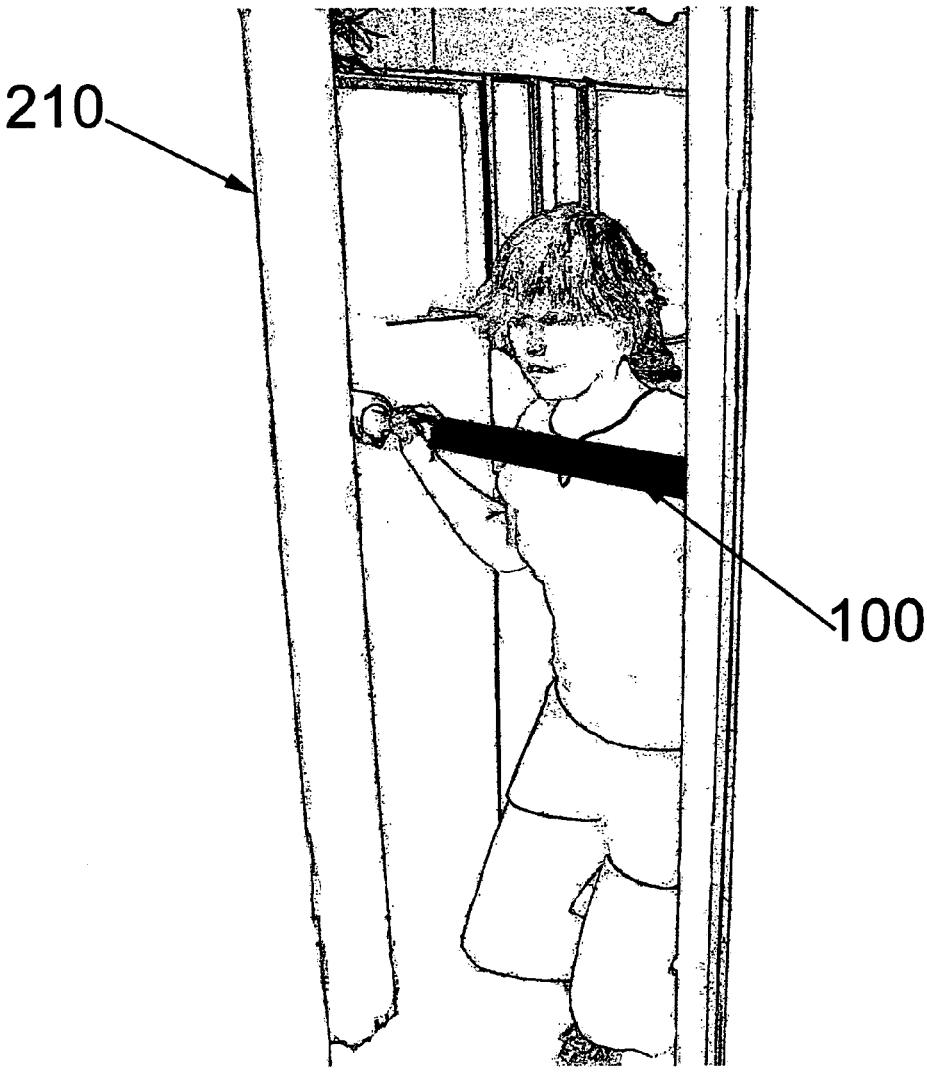
FIG. 3 illustrates an example of the first embodiment used in a doorframe example of the "Front Squat" exercise at an engaged position.

It should be appreciated that many other exercise that require horizontal stabilization or elastic resistance may be carried out with the present invention. The "Front Squat" is one such exercise variation. FIG. 3 illustrates an example of the first embodiment used in a doorframe example of the "Front Squat" exercise at an engaged position. The "Front Squat" exercise using the first embodiment of the present invention is performed similar to the regular Squat exercise described for FIG. 1, with the exception that adjustable exercise bar 100 is, instead, placed on the chest area, whereby the user may have a natural tendency to lean backwards towards the load bearing side of their body, e.g., leaning forward, which reinforces the engagement of wheel sections 130 onto the vertical guiding surface.

In embodiments of the present invention that include a resistance element, by way of example and not limitation, elastic resistance band 140 in the first and forth embodiments, those in the art will recognize a multiplicity of alternate resistance inducing means to suitably replace the elastic resistance bands. Some suitable alternatives include, but are not limited to tension tubes, springs, hydraulic means, or any suitable load inducing means that properly works according to the principles of the present invention. As with conventional resistance based exercise equipment, the attached resistance means is adjustable to a desired resistance level. Typically, for example, exercise bands or tension tubes are interchangeable and are available in various resistant level strengths including extra-light, light, medium, heavy and extra-heavy resistances. In the described examples, these various strength resistance exercise bands and/or tension tubes create a positive and negative resistance in the up and down body movement of the individual performing the Squat or front squat exercise.

Figure 4:
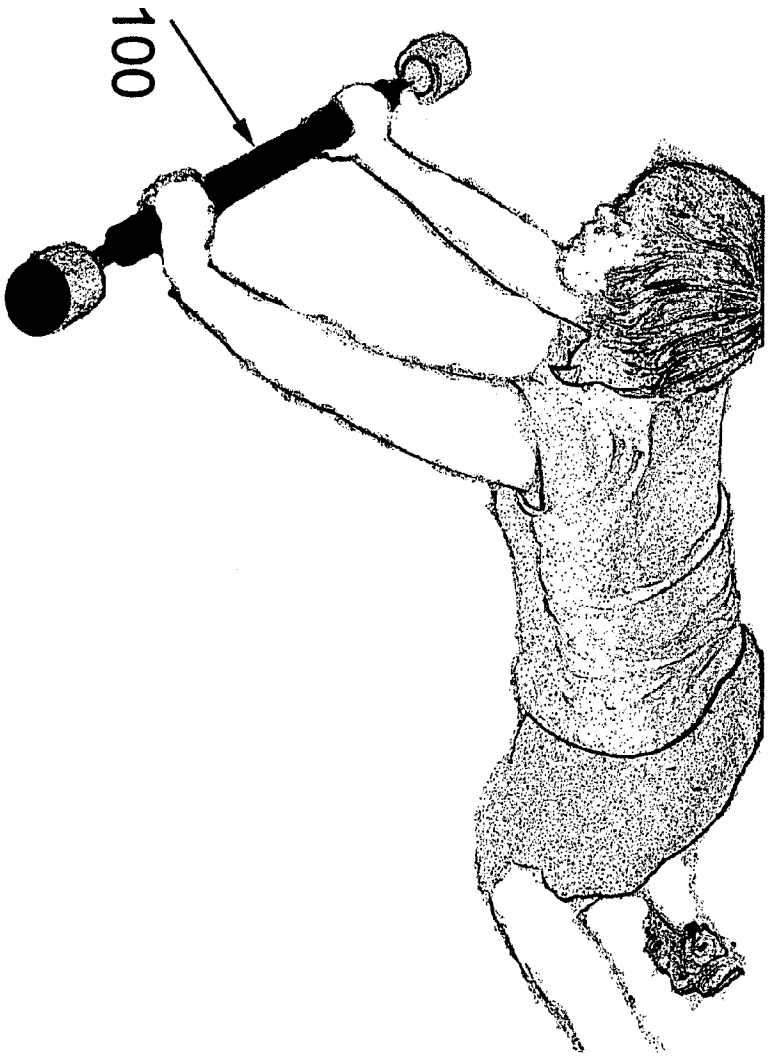
FIG. 4, illustrates an example an abdominal exercise using a second embodiment of the present invention.

Other exercises may use principally the wheel aspect or the resistance means aspect of the present invention, and may have variants that combine the two aspects. An example of a wheel-only exercise is a first version of the abdominal exercise shown by way of illustration in FIG. 4, which shows a use of the second embodiment of the present invention. This exercise is carried out by placing the adjustable exercise bar 100 on the floor, or a mat, and while the user is on their hands and knees, the adjustable bar is gripped with both hands, and the body is extended forward such that wheel sections 130 roll on the floor or mat, thereby facilitating a smooth, controlled forward extension ending towards a prone position. Upon extending to the desired forward extension distance, the user rolls adjustable exercise bar 100 back towards the starting position. A second version (not shown) of this abdominal exercise takes advantage of the added resistance provided the elastic resistance means (not shown), whereby the attached elastic resistance means may be placed abound a rear holding point such as under both knees or on the soles of the user's feet. Otherwise, the second version of the abdominal exercise proceeds similar to the first version, whereby the user experiences the positive resistance provided by the elastic resistance means while extending forward and negative resistance when returning backwards to the original position. The combination of the rolling and resistance aspects of the present embodiment in the second version of the abdominal exercise, exercises a very different set of muscles than that of the first version.

Exercises that principally use the resistance means aspect of the present invention (not shown) include common exercises such as biceps/triceps curls or back and shoulders exercises. In these exercises, the user may simply restrain the attached the resistance means at a distal fixation point, such as under the users feet while standing, grip the adjustable exercise bar, and lift in a curl manner to strengthen and tone biceps, or lift over head to strengthen and tone shoulders. The shoulders can also be strengthened by placing attached band or tube under the feet, and gripping the bar at hip level with both hands and pull arms straight up so that bar is under the chin. Return the bar to starting hip area and repeat as many times as desired, thereby creating a positive and negative resistance to help strengthen and tone the shoulder muscles. An exercise commonly referred to as the 'shoulder shrug' can be performed by placing a distal portion of the attached resistance means under the feet while standing, and while gripping the adjustable exercise bar at hip level with both hands, lifting the adjustable exercise bar by shrugging the shoulders and return to starting position by slowly relaxing the shoulders repeatedly as many times as desired to strengthen and tone the shoulder area. Another shoulder exercise that can be performed using the resistance means provided by the present invention is to place a distal portion of the attached band or tube under the feet, for example, grip the adjustable exercise bar at hip level, and while keeping the arms straight by on the side, slowly lifting the adjustable exercise bar out in front of until the arms are parallel with the floor and returning the bar back to the side or hip level, repeating the exercise as many times as desired to create a positive and negative resistance that strengthens and tones the shoulder muscle group.

An exercise commonly referred to as the 'shoulder press' can be performed with or without an ordinary chair. Without the chair, the user places a distal portion of the attached resistance means under their feet, and while gripping the adjustable exercise bar at hip level, lifting the adjustable exercise bar up over the head and returning to the starting position. The shoulder press exercise may be performed when sitting in a common household chair, whereby a distal portion of the attached resistance means is placed under a lower portion of the chair, and while seated, pressing the adjustable exercise bar from the chest area up over the head. A similar variation places the bar on the shoulders and presses the bar up over the head from this starting position and return. A triceps exercise can also be performed with or without the use of an ordinary chair. Without the chair the user would place attached resistance means under their feet, and place the adjustable exercise bar behind the head and resting on the shoulders such that the palms are facing upward, and bending the forearms forward so that the bar with the attached resistance means is up over the head, and then returned to the starting position behind the neck.

Having fully described at least one embodiment of the present invention, other equivalent or alternative methods of assisting in load balancing according to the present invention will be apparent to those skilled in the art. The invention has been described above by way of illustration, and the specific embodiments disclosed are not intended to limit the invention to the particular forms disclosed. For example, the particular implementation of the exercise bar and wheels may vary depending upon the requirements of particular application, whereby any suitable number of bar members or wheels may be used, and any suitable material, such as steel or aluminum for bar members, or texturized rubber, for example, may used. Moreover, the vertical guiding surface described in the foregoing was directed to doorframe related implementations; however, similar techniques may be applied to any surface suitable to serve as a vertical guiding surface according to the teachings the present invention, and are, hence, contemplated as within the scope of the present invention. The invention is thus to cover all modifications, equivalents, and alternatives falling within the spirit and scope of the following claims.

I claim:

1. An exercise device comprising:

a gripping member configured to be suitable for gripping with both hands by a user, the gripping member being further configured with at least two end portions, the end portions joined with an adjustment member that enables a length of the gripping member to be adjusted within a predetermined range;

an adjustment member cover covering the adjustment member that provides safety to the user; and two wheels disposed about and rotatably joined to the end portions of the gripping member, each of the wheels comprising a width greater than a diameter of the wheels and a plurality of circumferential grooves for rolling on a vertical surface where horizontal stability is improved at least by the horizontal constraining tendency of normal and frictional forces generated as the wheels engage the vertical surface, the wheels further being configured to engage a vertical motion guide wherein each of the wheels is joined to a one of the end portions in a manner such that sides of each of the wheels are substantially unobstructed for engagement to the vertical motion guide, thereby assisting the user to balance against the vertical motion guide while performing a squat exercise within a space provided by the vertical motion guide.

2. The exercise device of claim 1, wherein the length adjustment means comprises a threaded connection.

3. The exercise device of claim 2, wherein the vertical motion guide is a doorframe and the predetermined range is the range of widths of common doorframes.

4. The exercise device of claim 1, further comprising a resistance means attached to the gripping member such that a resistance force is generated that opposes, in at least one direction, motion of the gripping member induced by the user.

5. The exercise device of claim 4, wherein the resistance means is an elastic band, tension tube, spring, or a hydraulic mechanism.

6. The exercise device of claim 4, wherein the resistance means is removably attached to at least one of the end portions.

7. The exercise device of claim 2, wherein the predetermined range is at least the width of a common doorframe.

8. The exercise device of claim 1, wherein the two wheels are unobstructed to engage a surface of a doorframe or a wall surface just beyond the doorframe such that the two wheels can sufficiently roll on either surface and provide adequate lateral stabilization of the user performing a squatting exercise inside the doorframe area when gripping the gripping member with at least one hand.

* * * * *